United States Patent [19]

Chapelsky et al.

[11] 4,080,989

[45] Mar. 28, 1978

[54] TUBE CONNECTOR FOR FLUID CONTAINER

[75] Inventors: Orest Chapelsky, Ann Arbor; Norman A. Zausmer, Oak Park, both of Mich.

[73] Assignee: Michlin Chemical Corporation, Detroit, Mich.

[21] Appl. No.: 688,037

[22] Filed: May 19, 1976

[51] Int. Cl.[2] ..... F16K 24/00; F16L 55/14

[52] U.S. Cl. ..... 137/588; 137/592; 137/637.1; 251/4; 215/309

[58] Field of Search ..... 251/4; 215/309; 137/637.1, 590, 592, 588

[56] References Cited

U.S. PATENT DOCUMENTS

| | | | |
|---|---|---|---|
| 470,776 | 3/1892 | Beehler | 251/4 |
| 2,622,420 | 12/1952 | Rice | 215/309 |
| 2,684,674 | 7/1954 | Archer | 251/4 |
| 2,747,935 | 5/1956 | Szantay | 251/4 |
| 3,103,335 | 9/1963 | Martinez | 251/4 |
| 3,216,418 | 11/1965 | Scislowicz | 251/4 |
| 3,424,156 | 1/1969 | Smith | 251/4 |
| 3,655,102 | 4/1972 | Moran | 215/309 |
| 3,813,223 | 5/1974 | Fleck | 215/309 |
| 3,842,870 | 10/1974 | Burgess | 137/588 |
| 3,868,039 | 2/1975 | Holbrook | 215/309 |

*Primary Examiner*—William R. Cline
*Assistant Examiner*—H. Jay Spiegel
*Attorney, Agent, or Firm*—Krass & Young

[57] ABSTRACT

A molded plastic cap for a bottle of ammonium hydroxide includes a pair of flexible tubing sections which pass through the cap and allow the bottle to be connected to a pair of fluid conduits for a vapor-type diazo development machine. The first tubing connector has an extension into the bottle which terminates adjacent to the bottom wall of the bottle. Both of the tubing sections are adapted to be retained in a bent, collapsed position, by a notched retainer formed on the cap, to close off the tubing connectors. A projection on the second tubing section, which overlies the first tubing section when both are in a collapsed position, assures that the second tube will be opened first, to prevent pressure which may have built up in the container while it was in a sealed condition from forcing liquid out of the second section.

7 Claims, 4 Drawing Figures

Fig-4
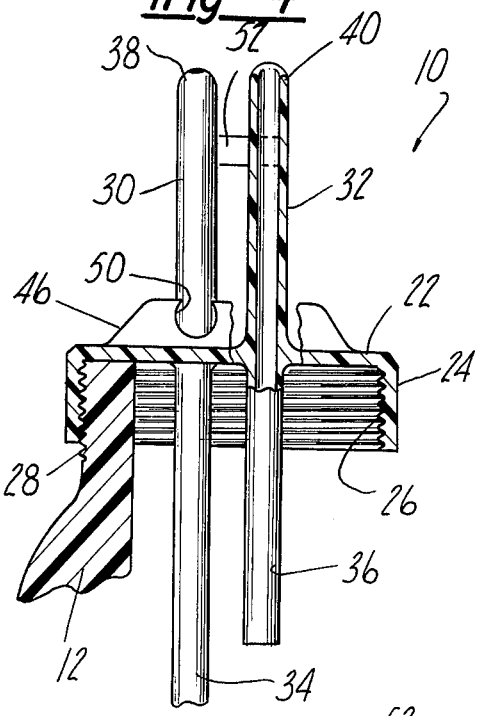
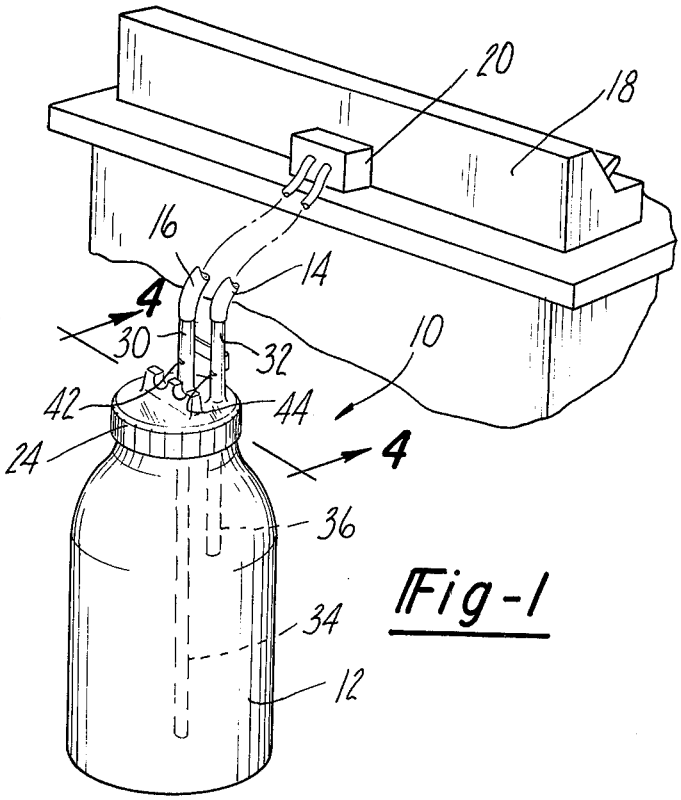
Fig-1
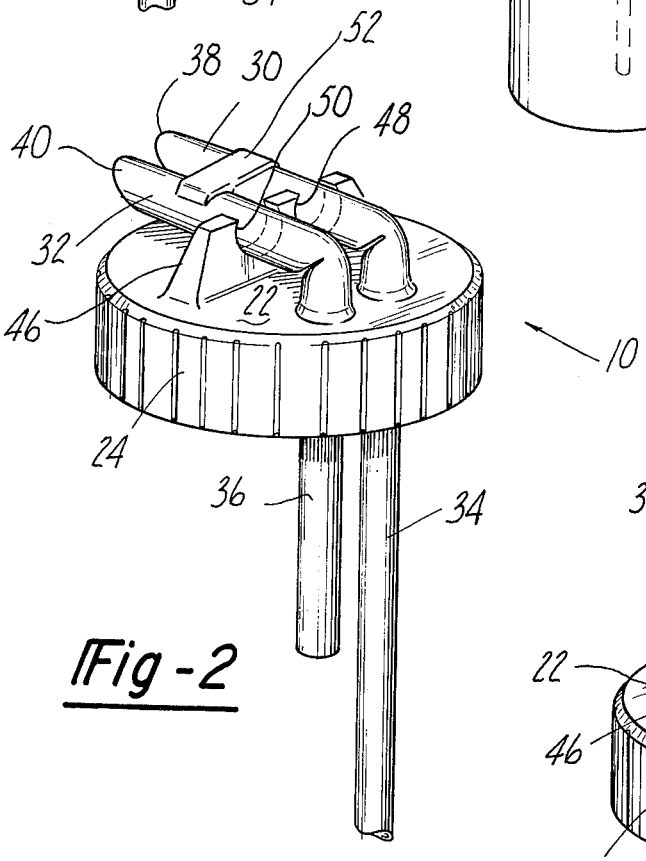
Fig-2
Fig-3
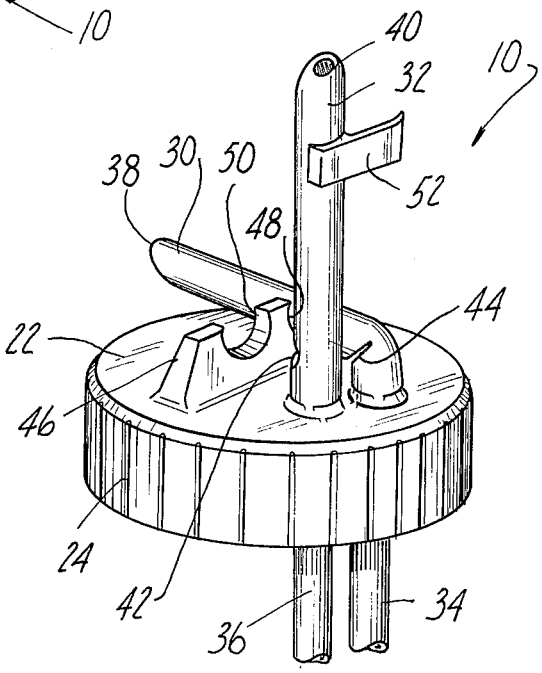

TUBE CONNECTOR FOR FLUID CONTAINER

BACKGROUND OF THE INVENTION

1. Field of the Invention

This invention relates to connectors for joining fluid conduits to a fluid container, and more particularly to a cap structure for the container, incorporating the connectors, means for retaining the connectors in a bent position wherein their walls are collapsed to seal off fluid flow, and means for assuring the order in which the connectors are unbent to an open position.

2. Prior Art

A popular method of reproducing mechanical drawings and the like involves the use of diazo coated papers. The reproduction process involves exposing coated papers to light, through the drawings to be reproduced, and then developing the exposed papers by a combination of ammonia vapor and water vapor. In one type of developing machine, exemplified by the disclosure of U.S. Pat. No. 3,915,708, ammonia and water vapor is derived by pumping air from the development chamber through a container of ammonium hydroxide and connecting the air space above the fluid to the development chamber. In this manner, the air picks up ammonia and water vapor, and carries it to the development chamber. These "vapor-type" machines release minimum amounts of the noxious ammonia vapor to the environment since the developing chamber is vented back to the liquid container through a vacuum system.

After some period of use the ammonium hydroxide becomes depleted of ammonia and the container must be replaced. A considerable amount of pressure may have built up in the bottle so that a large volume of vapor is released when the container is opened. Often the amount of ammonia vapor released under these circumstances causes the nearby air to contain a higher concentration of ammonia vapor than that allowed by government regulations such as those promulgated under the Occupational Safety Hazard Act.

The present invention is broadly directed toward a container suitable for retaining ammonium hydroxide in a sealed, stored condition, and for connecting the container to conduits for diazo development machines, either liquid or vapor without releasing any ammonia vapor into the atmosphere. While the present invention was conceived under the impetus of this particular problem it has application to a broader range of situations wherein it is desirable to provide a sealable outlet for a fluid container.

SUMMARY OF THE INVENTION

The invention broadly consists of a fluid container, or a cap for a fluid container, having a pair of short tubing, connector sections extending outwardly from the container so that they may be coupled to the ends of a pair of fluid conduits, typically by a coaxial press fit. The tubing sections are formed of flexible plastic designed so that when they are bent angularly to their normal extension, their interior walls collapse to seal the tubes. The invention further provides means formed on the container, or cap, for retaining the tubes in their bent, sealed position. In the preferred embodiment of the invention, this simply comprises a notched wall extending outwardly from the container. The tubes are bent and forced into the notches which retain the tubes with a friction fit.

An embodiment of the invention used with ammonium hydroxide, which will be subsequently disclosed in detail, takes the form of a cap for the liquid container. One of the connector tubes has an extension into the liquid container to nearly the bottom wall of the container, so that vapor forced through this tube, from the diazo development chamber, will bubble upwardly through practically the full height of liquid in the chamber. The other connector has a short extension into the container, so that its opening is above the normal fluid level in the container. This section joins to the return conduit to the developing chamber. The outer ends of the tubes may be molded with a seal for shipment purposes. When the container is to be used the end seals may be snipped off while the tubes are retained in the notched locking block, in a sealed condition. Since their ends project beyond the notches they may then be connected to fluid conduits to the machine while still sealed. After connection the tubing sections may be unbent so that any pressurized vapor flows to the developing chamber.

In releasing the sealed tubing connectors, it is important that the connector with the short extension into the container, the one that attaches to the return line to the vapor machine, be released first. This will allow any pressure which has built up in the sealed container to be relieved by the flow of vapor from the container. If the other tube were released first the liquid ammonium hydroxide might be forced out of the container. If the connectors were not joined to fluid conduits when this occurred the hydroxide might spray into the room. If the connectors are joined to fluid conduits when the incorrect tube is released first the liquid ammonia may be forced into the development chamber, which is not adapted to handle liquid, possibly ruining prints being developed.

To insure the proper order of release of the sealed connectors the present invention provides means for preventing the connector joined to the long interior tube from being released until the other connector has first been released. In the preferred embodiment of the invention this means takes the form of a safety arm, affixed to the connector that must be released first, which projects over the other connector when the two are in the bent position. This arm prevents the connector joined to the long tube from being moved into the sealed position after the connector joined to the short tube has been moved to the sealed position. Accordingly, the connector joined to the long tube must be moved into sealed position first and then the connector with the short tube moved into sealed position, so that the safety arm covers the connector joined to the long tube. This insures that the connector joined to the short tube will be unsealed first.

In the preferred embodiment of the invention the connectors, the notched retainer and the safety arm, are all molded integrally into a screw cap for the container. The resulting structure is low in cost, easy to use, and virtually fool-proof. It allows the easy attachment of fluid conduits from a vapor-type machine to an ammonium hydroxide container without the release of any appreciable ammonia vapor into the atmosphere.

Other objectives, advantages and applications of the invention will be made apparent by the following detailed description of a preferred embodiment of the invention. The description makes reference to the accompanying drawings in which:

FIG. 1 is a perspective view of a container for ammonium hydroxide, coupled to a vapor-type diazo development machine through fluid conduits attached to a cap, formed in accordance with the present invention.

FIG. 2 is a perspective view of the cap of the present invention with the connectors in sealed condition;

FIG. 3 is a sectional view of the cap of the present invention, taken along line 3—3 of FIG. 2; and FIG. 4 is a sectional view of the cap taken along line 4—4 of FIG. 2.

Referring to the drawings, a preferred embodiment of the invention takes the form of a cap, generally indicated at 10, which acts as the closure for a plastic bottle 12, containing ammonium hydroxide solution. The bottle is adapted to be coupled, through the cap 10, with a pair of flexible conduits or tubes 14 and 16, which couple to a vapor-type diazo developing machine 18. The conduit 14 connects to an exhaust pump 20 forming part of the machine so that exhaust from a developing machine chamber is fed away from the machine in conduit 14. The conduit 16 carries ammonia and water vapors from the container 12 back to the developing chamber of the machine 18. The cap may also be used with developing machines that employ liquid in the development chamber.

The cap 10 has a generally flat base 22 with a downturned skirt 24. The internal diameter of the skirt 24 is threaded, as at 26, so that the cap can be removably attached to the threaded neck 28 of the container 12.

A pair of flexible tubular connectors, 30 and 32, are molded integrally with the base cap 10 at spaced points along the edge of the cap. The tubular connectors 30 and 32 are formed with sufficient rigidity so that in an unstressed condition they extend upwardly, normally to the face 22 of the cap. The connector 30 is formed as an extension of a tube 34, which projects downwardly from the underside of the cap 10. The tube 34 has a length slightly less than the height of the container 12 so that its open lower end, 36, is closely spaced with the base of the container 12. Similarly, the connector 32 is formed as an extension of a relatively short tube 36 that projects downwardly from the underside of the base 22 so its open lower end is above the top surface of any liquid in the container 12.

The connectors 30 and 32 are preferably formed of a relatively flexible plastic material and have rounded ends 38 and 40 respectively which allow them to make a press fit with the interiors of the tubular conduits 14 and 16. The rounded ends allow conduits 14 and 16 to be easily slipped over the connector ends 38 and 40 respectively and secured there by the press fit. The rounded ends may be molded in a sealed condition to insure that no vapor is released during shipping, and the user may snip the end seals off before use.

In alternative embodiments of the invention other forms of connector ends could be provided for joining the connectors 30 and 32 to various forms of conduit. For example, the conduit ends could be formed so as to slip inside the connector ends, or more complicated mating connectors could be employed.

The connectors 30 and 32 are preferably provided with notched sections 42 and 44, respectively, a short distance above the base. These notches allow the tubes to be manually forced into position wherein their free ends extend substantially parallel to the base 22 of the cap. In this position, their internal walls are collapsed, to seal off the fluid passages through the connectors 30 and 32. Other wall configurations, such as internal skirts, could be employed in alternative embodiments to secure the sealing action when the connectors are bent out of their normal extended position.

To retain the connectors 30 and 32 in their collapsed position, a plate 46 extends upwardly from the top side of the cap base 22, generally perpendicular to the base. The plate 46 is preferably aligned parallel to a line between the bases of the connectors 30 and 32 and between that line and the center of the cap 10. The plate 46 has a pair of generally U-shaped notches 48 and 50 formed downwardly from its upper side. These notches align with the connectors 30 and 32 in their bent positions and when the connectors 30 and 32 are bent downwardly and pressed into the notches 48 and 50, respectively, their side walls are slightly compressed, to retain them in the notches. In alternative embodiments, other means, such as straps or cams, could be employed to lock the connectors in their collapsed position.

An arm 52 is formed integrally with the connector 32 and projects normally to the axis of the connector, a short distance from its free end 40. The arm extends in the direction of the connector 30, so as to overlie a portion of the surface of that connector when the connectors 30 and 32 are aligned parallel to one another.

When the connector 32 is in a collapsed position, supported in the notch 50 in the plate 46, the arm 52 prevents the connector 30 from being moved to an upright position, if it is in a collapsed position, or from being moved into the collapsed position if it is in the upright position. Accordingly, if both the connectors 30 and 32 are to be moved from their upright positions to their collapsed positions, the connector 30 must be first moved to the collapsed position, because if the connector 32 is first moved to the collapsed position, the arm 52 blocks motion of the connector 30 into the locked position. When both of the connectors are in their locked position, it is necessary to lift the connector 32, opening its internal passage, before the connector 30 may be lifted. Accordingly, if pressure has built up in the container 12 while both of the connectors are sealed, the connector 32 must be released first, creating a flow of vapor outwardly from the container. If the connector 30 were opened first, the fluid in the container might be forced up the tube 34 and out of the connector 40.

The length of the connectors 30 and 32 are sufficient so that when they are in their collapsed position, retained within the plate 46, their free ends 38 and 40 respectively, project beyond the plate sufficiently to allow the conduits 14 and 16 to be joined to them. When a new container of ammonium hydroxide is to be attached to machine 18, the conduits 14 and 16 are slipped over the ends 38 and 40 of the connectors, while the connectors are in the collapsed position. Then the connector 32 is lifted out of the notch 50. If pressure has built up in the container, this will cause a flow of water vapor and ammonia vapor through the tube 16 and into the development chamber of the machine 18. The connector 30 is then lifted from the notch 48 and the machine is ready for operation.

When the pump 20 is turned on air evacuated from the developing chamber of the machine 18 is forced through the tube 16 into the connector 30 and through the tube 34, out the bottom 36. It then bubbles up through the liquid in the container. This pressurizes the air, ammonia vapor, and water vapor, in the container, over the liquid surface, and forces this mixture into the tube 36, then through the connector 32 to the tube 16 and to the machine 18.

The connectors 30 and 32 may be similarly moved to collapsed positions, in that order, before the conduits 14 and 16 are removed from the container of exhausted fluid to prevent release of any ammonia vapor to the atmosphere.

The embodiment of the invention in which an exclusive property is claimed are defined as follows:

1. A cap for a fluid container having means for joining a pair of fluid conduits to said container, comprising: a base adapted to be releasably secured to the container to close off an opening in the container; a pair of flexible tubing sections supported in the base so that their interiors form fluid passages through the base, and normally project away from the base in a direction opposite to the container; means formed on the base for releasably, simultaneously retaining both the tubing sections in a bent position wherein their walls are collapsed so as to close off fluid flow through them; and means carried by a first of said tubing sections for preventing placement of the second of said tubing sections into said means for retaining the tubing sections in a bent position, when the first of the tubing sections is supported within said means for retaining the tubing sections in a bent position.

2. A connector for joining a fluid conduit to a container for fluid comprising: a first length of tubing fixed in the container wall, projecting outwardly therefrom, and adapted to receive said fluid conduit in sealed engagement so that said tubing section forms an extension of said conduit, said tubing section having an unstressed extension along an elongate axis, and being collapsible, to block fluid flow when bent transversely to said axis; and means affixed to the container for retaining said extending section bent transversely to said axis to block the passage of fluid through the section; a second length of tubing, fixed in the wall of the container so as to project outwardly therefrom parallel to the first length of tubing, the second length of tubing having an unstressed extension along an elongate axis and being collapsible to block fluid flow when bent transversely to said axis; an elongated section of tubing within said container connecting to said second length of tubing; means affixed to the container for releasably retaining said second length of tubing bent transversely to said axis to prevent fluid flow through said second length of tubing; and means carried by said first length of tubing for preventing the engagement or disengagement of the second length of tubing with said means for retaining it bent transversely to said axis at such time as said first length of tubing section is retained in said means for retaining it bent transversely to its axis, whereby both said first and second lengths of tubing may be retained in their respective retaining means if said second length of tubing is engaged before said first length is engaged, and when both are retained said first length must be disengaged before said second may be disengaged.

3. The fluid conduit connector of claim 2 wherein said means for preventing engagement of said second length of tubing with said means for retaining it bent transversely to said axis when said first length of tubing is retained in said last said means, comprises an arm connected to said first length of tubing and adapted to overlie said means for retaining said second length of tubing bent transversely to its axis at such time as said first length of tubing section is retained in its means for retaining it bent transversely to its axis.

4. The fluid connector of claim 2 wherein said first and second lengths of tubing are formed as part of a cap section which is engageable with the container.

5. The fluid connector of claim 2 wherein said means for retaining said first length of tubing section bent transversely to its axis and said means for retaining said second length of tubing bent transversely to its axis both comprise notches formed in a wall extending away from the container wall.

6. The fluid connector of claim 2 in which said cap, said first and second lengths of tubing, said means for retaining said first length of tubing bent transversely to its axis, and said means for retaining said second length of tubing bent transversely to its axis are all formed integrally.

7. The fluid connector of claim 2 wherein said second length of tubing extends into the container to a point adjacent the side wall of the container opposite the cap.

* * * * *